US007878378B1

(12) United States Patent
Robinson

(10) Patent No.: US 7,878,378 B1
(45) **Date of Patent: *Feb. 1, 2011**

(54) MULTI-PURPOSE LIQUID APPLICATOR

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 56 days.

This patent is subject to a terminal disclaimer.

(21) Appl. No.: 12/321,720

(22) Filed: Jan. 23, 2009

Related U.S. Application Data

(63) Continuation of application No. 11/888,858, filed on Aug. 1, 2007, now Pat. No. 7,490,745, which is a continuation of application No. 10/092,100, filed on Mar. 6, 2002, now Pat. No. 7,270,251.

(60) Provisional application No. 60/273,671, filed on Mar. 6, 2001, provisional application No. 60/361,652, filed on Mar. 5, 2002.

(51) Int. Cl.
*B60P 3/22* (2006.01)

(52) U.S. Cl. ..... 222/608; 222/1; 222/181.1; 222/185.1; 222/611.1; 222/614; 222/617; 15/260; 15/264

(58) Field of Classification Search ..... 222/1, 222/614, 617, 608, 611.1, 556, 559, 565, 222/185.1, 181.1; 401/48; 239/563, 170; 15/260–264
See application file for complete search history.

(56) References Cited

U.S. PATENT DOCUMENTS 398,410 A * 2/1889 Laube ..... 220/2
627,273 A * 6/1899 Seibert ..... 220/762
929,597 A * 7/1909 Johnson ..... 239/73
1,036,922 A * 8/1912 Smith ..... 222/614
1,453,450 A * 5/1923 Dilas ..... 280/47.35
1,587,934 A * 6/1926 Bartlett ..... 222/460
1,767,840 A * 6/1930 Finnell ..... 15/264
1,918,986 A * 7/1933 Schulman ..... 15/263
2,322,808 A * 6/1943 Hothersall ..... 222/82
D156,145 S * 11/1949 Minnis ..... D32/53
D159,961 S * 9/1950 Davey ..... D34/24
2,594,176 A * 4/1952 Kaiser, Jr. ..... 15/264
3,399,903 A * 9/1968 Bailey ..... 280/47.34
3,747,154 A * 7/1973 O'Neil ..... 15/264
3,926,452 A * 12/1975 Goines ..... 280/79.2
4,319,761 A * 3/1982 Wells ..... 280/47.36
4,471,713 A * 9/1984 Cote et al. ..... 118/108
4,545,531 A * 10/1985 Williams ..... 239/150
4,630,965 A * 12/1986 Nguyen et al. ..... 404/107
4,638,948 A * 1/1987 Marlek ..... 239/722
4,713,859 A * 12/1987 Smith, Jr. ..... 15/264

(Continued)

*Primary Examiner*—Frederick C. Nicolas
(74) *Attorney, Agent, or Firm*—David E. Pritchard

(57) ABSTRACT

One aspect of the invention is directed to a method of applying a liquid to a surface from a wheeled receptacle that is disposed on the surface. The wheeled receptacle, itself, includes a circumferential sidewall, a bottom wall connected to the circumferential sidewall, at least two wheels, a steering handle for guiding the wheeled receptacle on the surface, and a spigot; and the wheeled receptacle contains a liquid. The method includes the steps of: opening the spigot, thereby dispensing a liquid through the spigot of the wheeled receptacle and onto the surface; and guiding the wheeled receptacle across the surface via the steering handle, thereby dispensing the liquid through the spigot of the wheeled receptacle onto a selected area of the surface.

4 Claims, 6 Drawing Sheets

U.S. PATENT DOCUMENTS 4,716,619 A * 1/1988 Young ..... 15/262
D305,948 S * 2/1990 Rentz ..... D32/53
4,908,904 A * 3/1990 Smith, Jr. ..... 15/264
5,254,167 A * 10/1993 Janoski et al. ..... 118/108
D344,379 S * 2/1994 Clark, Jr. ..... D32/53
D345,236 S * 3/1994 Chen ..... D32/53
5,333,353 A * 8/1994 Taylor ..... 15/264
5,366,309 A * 11/1994 Springall ..... 401/48
5,414,892 A * 5/1995 Clark, Jr. ..... 15/263
5,615,447 A * 4/1997 Hardesty et al. ..... 15/264
5,813,086 A * 9/1998 Ueno et al. ..... 15/320
5,846,334 A * 12/1998 Hoce ..... 134/21
5,918,343 A * 7/1999 Young ..... 15/262
5,920,944 A * 7/1999 Biggs et al. ..... 15/144.4
5,947,346 A * 9/1999 London ..... 222/608
6,017,163 A * 1/2000 Keppers et al. ..... 401/48
6,053,354 A * 4/2000 Niemeyer ..... 220/819
D429,396 S * 8/2000 Houry et al. ..... D32/53
6,206,980 B1 * 3/2001 Robinson ..... 134/21
6,283,170 B1 * 9/2001 Robinson ..... 141/1
6,487,747 B2 * 12/2002 Cavalheiro ..... 15/143.1
7,270,251 B1 * 9/2007 Robinson ..... 222/608
7,490,745 B1 * 2/2009 Robinson ..... 222/608

* cited by examiner

MULTI-PURPOSE LIQUID APPLICATOR

CROSS-REFERENCE TO RELATED PATENT DOCUMENTS

This patent document is a continuation of application Ser. No. 11/888,858, filed on Aug. 1, 2007, now U.S. Pat. No. 7,490,745, entitled "Multi-Purpose Liquid Applicator" and issued on Feb. 17, 2009, which is a continuation of application Ser. No. 10/092,100, filed on Mar. 6, 2002, now U.S. Pat. No. 7,270,251, entitled "Multi-Purpose Liquid Applicator" and issued on Sep. 18, 2007. This patent document and U.S. Pat. No. 7,490,745 claim the benefit of the filing date of: U.S. Pat. No. 7,270,251; Provisional Application No. 60/273,671, entitled "Multi-Purpose Chemical Applicator" and filed on Mar. 6, 2001; and Provisional Application No. 60/361,652, entitled "Multi-Purpose Liquid Applicator" and filed on Mar. 5, 2002. The entire disclosure of each of U.S. Pat. No. 7,490,745, U.S. Pat. No. 7,270,251, Provisional Application No. 60/273,671, and Provisional Application No. 60/361,652 is incorporated into this patent document by reference.

BACKGROUND OF THE INVENTION

1. Field of the Invention

This invention is directed to a wheeled receptacle designed to receive and contain a cleaning liquid, to transport the cleaning liquid, and to provide a user with access to the cleaning liquid for use in cleaning a hard surface, such as a floor, wall, or the like.

2. Description of the Related Art

Maintaining the cleanliness of commercial, industrial, institutional, and public buildings is an ongoing effort, and at times, an effort which seems more like a losing battle. This is particularly true for hard-surface floors in high-traffic areas, for example, classrooms, hallways, restrooms, locker rooms, cafeterias, and food-service kitchens, where the volume of traffic in the particular area may make it difficult to maintain the cleanliness of the flooring.

Depending upon the particular type of floor, building-maintenance workers typically maintain the flooring by performing one or more of routine floor cleaning (i.e., dust mopping and/or wet mopping), floor finishing (also referred to as floor waxing), floor stripping, and floor degreasing.

Unfortunately, workers are provided with tools that are relatively ineffective and inefficient for performing these floor-maintenance tasks. For example, routine floor cleaning involves two separate processes, with each process calling for a different tool. In further detail, when dusting a floor, a worker pushes a dry dustmop across the floor, with some of the dust and dirt collecting in the dustmop, and much of the dust, dirt, and trash piling up along the front of the dustmop. Once the worker has made several passes with the dustmop, they then shake out the contents of the dustmop, either into a waste receptacle or onto a section of the floor, itself. In either case, dust and dirt are released back into the air. Then, in a totally separate process, the worker swabs down the floor using a wet mop and a mop bucket filled with water or a cleaning solution. Depending on the cleanliness of the mop, the worker may be able to make a good start in cleaning the floor using the wet mop and mop bucket. However, as soon as the worker wrings the soiled water from the mop into the mop bucket, then, each time the worker plunges the mop into the bucket and wrings out the mop, both the mop and the "cleaning water" become more and more dirty. The end result is that a dirty floor gets cleaned by pushing dirty water around with a dirty mop. At best, the floor surface may have the appearance of being clean if concentrated spots of highly visible soil have been removed or spread around. In reality, however, given the limitation of these tools, the worker still is simply pushing dirt around the floor, as evidenced by the "5-o'clock shadow" of dirt seen frequently along the surface of baseboards and walls adjacent the floor, as well as the "finger-painting-like streaks" left by the mop when the water on the floor dries.

Building-maintenance workers also use the conventional mop/mop-bucket system for floor-finishing-, floor-stripping-, and floor-degreasing-applications. As is the case with the general cleaning methods described above, the mop/mop-bucket system is relatively ineffective and inefficient. For example, when a worker uses such tools to apply floor finish, the end result frequently is a finish with bubbles and streaks, and/or a finish in which the coats of finish are dull, hazy, and uneven. Accordingly, given the relative ineffectiveness and/or inefficiency of the various tools given to building-maintenance workers for use in floor care, floors often are not cleaned as well, or as frequently, as they should be, and morale and job satisfaction among many building-maintenance workers are relatively low.

SUMMARY OF THE INVENTION

One aspect of the invention is directed to a method of applying a liquid to a surface from a wheeled receptacle that is disposed on the surface. The wheeled receptacle, itself, includes a circumferential sidewall, a bottom wall connected to the circumferential sidewall, at least two wheels, a steering handle for guiding the wheeled receptacle on the surface, and a spigot; and the wheeled receptacle contains a liquid. The method includes the steps of: opening the spigot, thereby dispensing a liquid through the spigot of the wheeled receptacle and onto the surface; and guiding the wheeled receptacle across the surface via the steering handle, thereby dispensing the liquid through the spigot of the wheeled receptacle onto a selected area of the surface.

If desired, the spigot may have a selectively-adjustable valve which is operable between a fully-open position and a fully-closed position. In such a case, the method may include the step of adjusting the selectively-adjustable valve to a position between the fully-open position and the fully-closed position inclusive, thereby regulating the rate at which the liquid flows from the spigot. Also, if desired, the spigot may include a spigot handle connected to the selectively-adjustable valve. In this instance, the adjusting step further includes turning the spigot handle, thereby adjusting the selectively-adjustable valve to a position between the fully-open position and the fully-closed position inclusive. The wheeled receptacle also has a speed, and the guiding step may include adjusting the speed of the wheeled receptacle across the surface, thereby regulating the amount of the liquid that is dispensed onto the selected area of the surface.

If desired, the wheeled receptacle may have a width indicator. If so, the method may further include the step of comparing the width of the liquid on the surface with the width indicator. The width indicator may have a selectively-adjustable width, in which case the method may further include the step of adjusting the width of the width indicator.

The wheeled receptacle may further include a mop-wringer, with the steering handle of the wheeled receptacle being connected to the mop-wringer. Also, in one version, the mop-wringer, itself, has a handle, with the steering handle of the wheeled receptacle being the mop-wringer handle.

If desired, the method may further include the step of determining, prior to the guiding step, a path for the wheeled receptacle to take across the surface, with the path determining the selected area of the surface. The shape of the path may be an inverted, substantially-U-shaped path, as viewed from above the surface, with such a path having a first leg-portion and a second leg-portion connected by a base portion. The guiding step may include following the path established in the determining step, whereby a bead of the liquid is dispensed onto the selected area of the surface. The method may further include the step of spreading the liquid from the selected area to another area of the surface, using a floor tool. Typically, the floor tool has a floor-contacting member and a floor-tool handle connected to the floor-contacting member. In such a case, the spreading step includes moving the floor-contacting member in a serpentine pattern via the floor-tool handle. The serpentine pattern, itself, may be sufficiently wide so that the floor-contacting member passes across the bead of the liquid at both the first leg-portion and the second leg-portion.

The floor-tool handle may include a bend, and the serpentine pattern may include a left-to-right sweep connected to a right-to-left sweep, with the spreading step further including holding the floor-tool handle at the bend, and using leg muscles to shift user body-weight during the left-to-right sweep and the right-to-left sweep. The floor-contacting member may have a first end, with the first end typically having an upwardly extending surface. If desired, the spreading step may further include maintaining the first end as a leading end throughout the serpentine pattern. The floor-contacting member also may include a bottom surface, in which case the method may further include the step of attaching a pad to both the first-end surface and the bottom surface.

Another aspect of the invention is directed to a wheeled receptacle for applying a liquid to a surface on which the wheeled receptacle is supported. The wheeled receptacle includes: a circumferential sidewall; a bottom wall connected to the circumferential sidewall; at least two wheels; a steering handle for guiding the wheeled receptacle on the surface; a spigot through which a liquid may flow onto a surface; and a spigot handle connected to a spigot, with the spigot handle being elongated and extending upward from the spigot.

The wheeled receptacle also may include a mop-wringer, with the steering handle being connected to the mop-wringer. Also, if desired, the mop-wringer may have a handle, with the steering handle of the wheeled receptacle being the mop-wringer handle.

The wheeled receptacle also may include a width indicator, whereby a user may compare the width of a liquid, which has flowed through the spigot onto the surface, with the width indicator. The width indicator may have a selectively-adjustable width, whereby a user may adjust the width of the width indicator. Also, if desired, the width indicator may include a horizontal member, and the horizontal member, itself, may include width indicia. The width indicia may include at least two outwardly-extending tabs; and, if desired, at least one of the tabs may be selectively-adjustable along the length of the horizontal member.

In addition, the wheeled receptacle has a back. And, if desired, the spigot and the spigot handle may be located at the back of the wheeled receptacle. Also, the width indicator may be located at the back of the wheeled receptacle. In addition, if desired, the wheeled receptacle may include a further handle at the back of the receptacle, with the handle typically being substantially U-shaped. Also, this further handle may include the width indicator.

If desired, the wheeled receptacle may include a third wheel, with at least one of the wheels being a non-caster wheel, and at least another of the wheels being a caster wheel. The wheeled receptacle also may include a fourth wheel. In such a version, two of the wheels may be non-caster wheels, and two of the wheels may be caster wheels. Also, if desired, the two non-caster wheels may be positioned at the back of the wheeled receptacle, while the two caster wheels may be positioned at the front of the receptacle.

A further aspect of the invention is directed to a wheeled receptacle which includes: a circumferential sidewall; a bottom wall connected to the circumferential sidewall; at least two wheels; a steering handle for guiding the wheeled receptacle on the surface; a spigot through which a liquid may flow onto a surface; and a width indicator, whereby a user may compare the width of a liquid, which has flowed through the spigot onto a surface, with the width indicator.

BRIEF DESCRIPTION OF THE DRAWINGS

The accompanying drawings, which are incorporated in, and constitute a part of, this specification, illustrate embodiments of the invention and, together with the general description of the invention given above, and the detailed description of versions of the invention given below, serve to explain the principles of the invention.

DETAILED DESCRIPTION OF THE DRAWINGS

Figure 1:
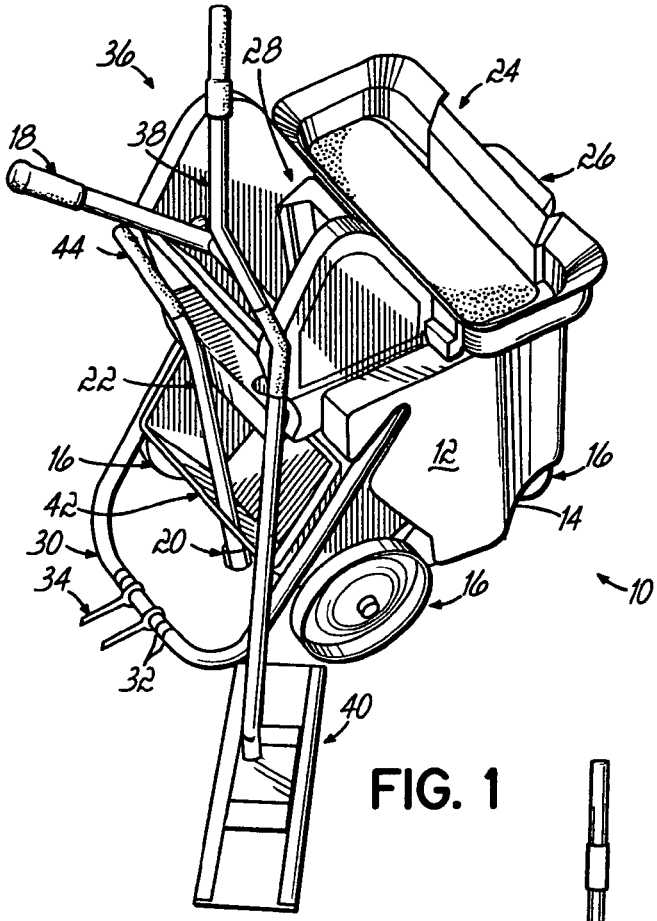
FIG. 1 is an elevated perspective view of one version of the multi-purpose liquid applicator in accordance with the principles of the invention.
Figure 2:
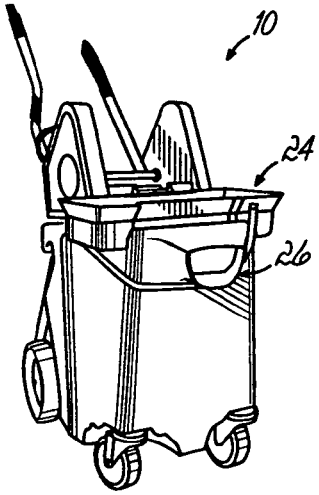
FIG. 2 is a front perspective view of the version of FIG. 1.

FIG. 1 shows a wheeled receptacle 10 for applying a liquid to a surface on which the wheeled receptacle 10 is supported, in accordance with the principles of the invention. The wheeled receptacle 10 includes a circumferential sidewall 12, a bottom wall 14 connected to the circumferential sidewall 12, and a plurality of wheels 16. The wheeled receptacle 10 also includes a steering handle 18 for guiding the wheeled receptacle 10 on the surface. In addition, the wheeled receptacle 10 includes a spigot 20 through which a liquid may flow onto a surface, and a spigot handle 22 connected to the spigot 20, with the spigot handle 22 being elongated and extending upward from the spigot 20. With reference to FIGS. 1 and 2, this particular receptacle 10 further includes a tray 24 for receiving and storing cleaning pads, such as, for example, reusable microfiber cleaning pads. The wheeled receptacle 10 also has a pouring spout 26 at its front, a mop wringer 28 at its top, and a substantially U-shaped lifting lever arm 30 at its back. As seen in FIG. 1, the lever arm 30 has a width indicator along the length of the horizontal member of the lever arm 30. This particular width indicator includes width indicia in the form of measurement markings 32 and two selectively-adjustable outwardly-extending tabs or fingers 34. Also, as best seen in FIG. 1, the wheeled receptacle 10 is shown in combination with a floor tool, with the floor tool 36 having a floor-tool handle in the form of an adjustable-length double-bend handle 38, and a floor-contacting member in the form of a rectangular frame 40, with the handle 38 being pivotally connected to the frame 40.

The vast majority of the components of the wheeled receptacle 10 are made and assembled as described in detail in Robinson U.S. Pat. No. 6,283,170 entitled "Ergonomic, Liquid-Transport Container" and issued on Sep. 4, 2001 ("the '170 patent"), the entire disclosure of which is hereby incorporated by reference. The additional materials and methods used to form the wheeled receptacle 10 are described immediately below.

Figure 3:
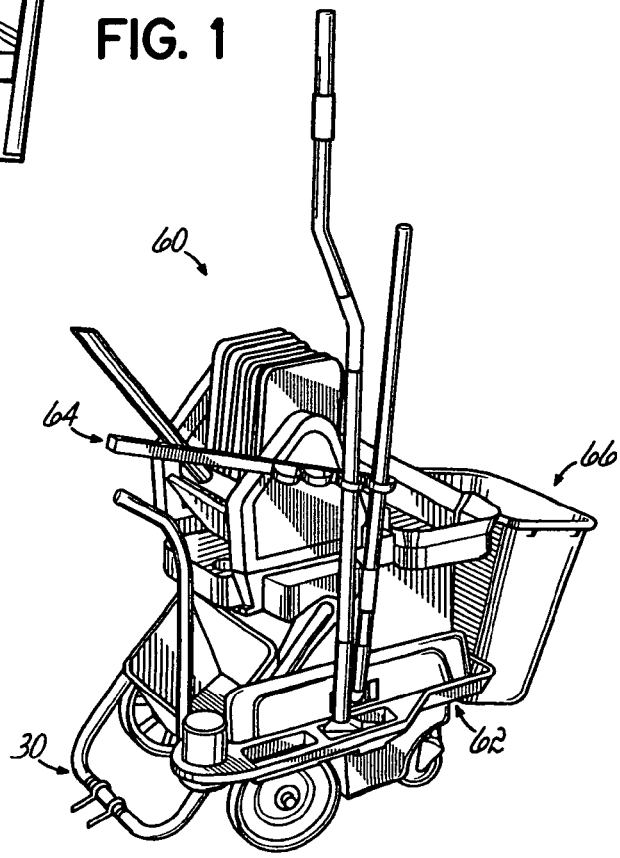
FIG. 3 is an elevated perspective view of another version of the multi-purpose liquid applicator in accordance with the invention.

In order to install the spigot 20, first a hole (not shown) is drilled in the circumferential sidewall 21, at the back of the wheeled receptacle 10 adjacent the bottom wall 14. With reference to FIGS. 2 and 3 of the '170 patent, this hole is drilled in the vertical portion of the back wall beneath the storage compartment (28) and axle (134). The pipe-thread fitting then is installed using conventional spin welding. Additionally, a hole is cut in the storage-compartment wall 42, for receiving the elongated and upwardly-extending spigot handle 22. At this point, the spigot 20 may be threaded onto the pipe fitting and the spigot handle 22 may be securely, yet releasably, connected to the spigot 20 (including the spigot valve) using a cotter pin or the like. The elongated handle 22, itself, may be formed of any suitable material, with one example being PVC piping. As shown, the handle 22 has a bend near the top, in order to provide a torquing portion 44. Also, if desired, a comfortable grip may be placed onto and over this torquing portion 44. Any commercially available spigot may be used, with one example being a spigot available from the Valley Janitor Supply Co. of Hamilton, Ohio under the product code JGSPG.

The pad tray 24 may be formed of any suitable material, with one non-limiting example being polyethylene. Also, if plastic is used, the pad tray 24 may be formed using any conventional plastic molding technique. For example, if desired, the pad tray 24 may be made using the vacuum-forming technique.

With regard to the floor tool 36, the floor-tool handle may be an ESOM-QC swivel handle available from the Biggs Corporation of Carson City, Nev. The floor-contacting member of the floor tool may be a KAI S216X frame available from Tuway, Inc. of Birmingham, Mich. Any suitable, commercially-available pad may be used with the floor tool 36. If desired, for floor-maintenance applications such as applying floor finish, the B-111RM05 pad from the Charles Young Co. of City of Industry, Calif. may be used. Also, for floor-care applications such as floor stripping, floor degreasing, and floor cleaning, the T-451RM01 pad from the Charles Young Co. may be used. When applying floor finish to a wooden floor, if desired, a T-Bar floor tool such as the model 6223, 24 inch T-Bar from Padco Inc. of Minneapolis, Minn. may be used. In addition, when trying to reach hard-to-reach surfaces, for example, tops of lockers, upper-wall portions, and the like, if desired, a telescopic handle such as the MOP-140 handle from the Charles Young Co. of City of Industry, Calif. may be used.

FIG. 3 shows another version of the wheeled receptacle 60. This particular wheeled receptacle 60 includes all of the aspects of the wheeled receptacle 10 described above in connection with FIGS. 1 and 2. However, this wheeled receptacle 60 further includes a tool tray 62 and corresponding tool rack 64, as well as a removable storage compartment 66. The tool rack 64 has a series of tool-stowing assemblies along its length. Each such assembly includes a strap having a first end and a second end, with the first end being secured to a portion of the tool rack 64, and the second end being releasably securable to an adjacent portion of the tool rack 64. The second end may be releasably secured using any suitable material, including, for example, a snap member that corresponds with a snap member on the tool rack 64. The tool rack 64, itself, may be made of a tubular piece of steel having a plastic cap at each end, with the tubular piece being bolted to the mop wringer 28 at an angle, such that the tubular piece becomes more elevated as it extends along the side toward the back of the wheeled receptacle 60. If desired, the portion of the tool rack 64 positioned at the back of the wheeled receptacle 60 also may be used as a handle.

The corresponding tool tray 62 is mounted along the side of a receptacle 60 beneath the tool rack 64. If desired, the tray 62 may be made using the same vacuum-forming method used to form the pad tray 24. Also, the tool tray 62 may be secured to the side of the wheeled receptacle 60 using molded threaded inserts.

The removable storage compartment 66 may be formed by modifying a conventional wastebasket. For example, a steel bar may be secured along an upper elongated rim of a wastebasket. In addition, openings may be formed in the sidewall of the wastebasket, beneath the rim and metal bar, and straps may be securely fastened around the bar via these openings. The straps then are releasably attachable to the pouring spout (not shown) at the front of the wheeled receptacle 60, using snap fasteners or the like. Also, if desired, one or more holes may be formed on the exterior surface of the opposing sidewalls of the mop wringer 28, for receiving the ends of an elasticized shock cord or bungee cord. In this fashion, another cleaning tool, for example an upright- or backpack-vacuum cleaner may be releasably stowed at the back of the wheeled receptacle 10, 60. In further detail, the base of the vacuum cleaner may rest on the horizontal portion of the lifting lever handle 30, with the bungee cord releasably holding the vacuum cleaner up against the back of the wheeled receptacle 10, 60.

Given the additional components described above, this version of the wheeled receptacle is able to carry an assortment of tools and supplies for whole-building cleaning.

Figure 4:
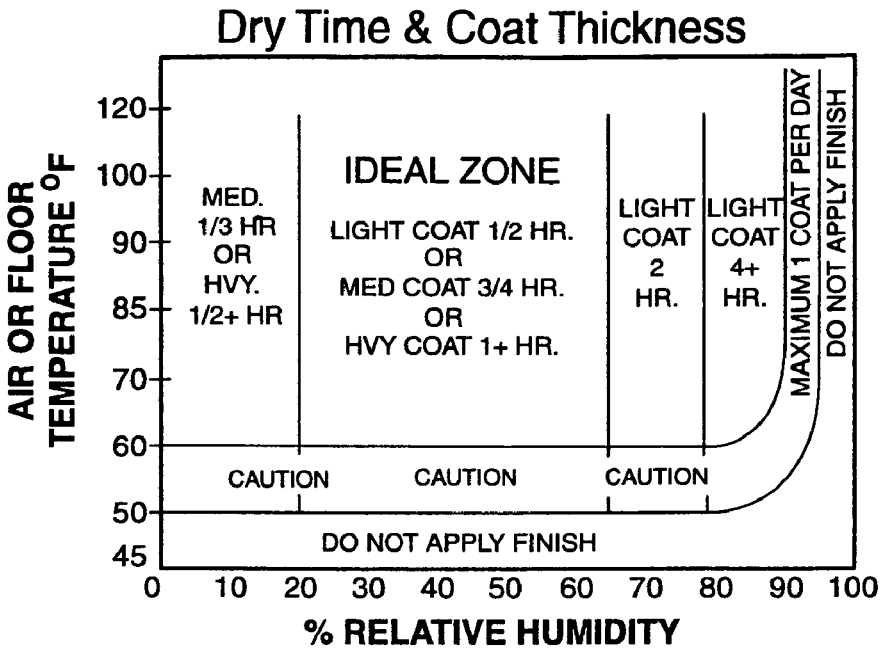
FIG. 4 is a graph of temperature v. % relative humidity.
Figure 5:
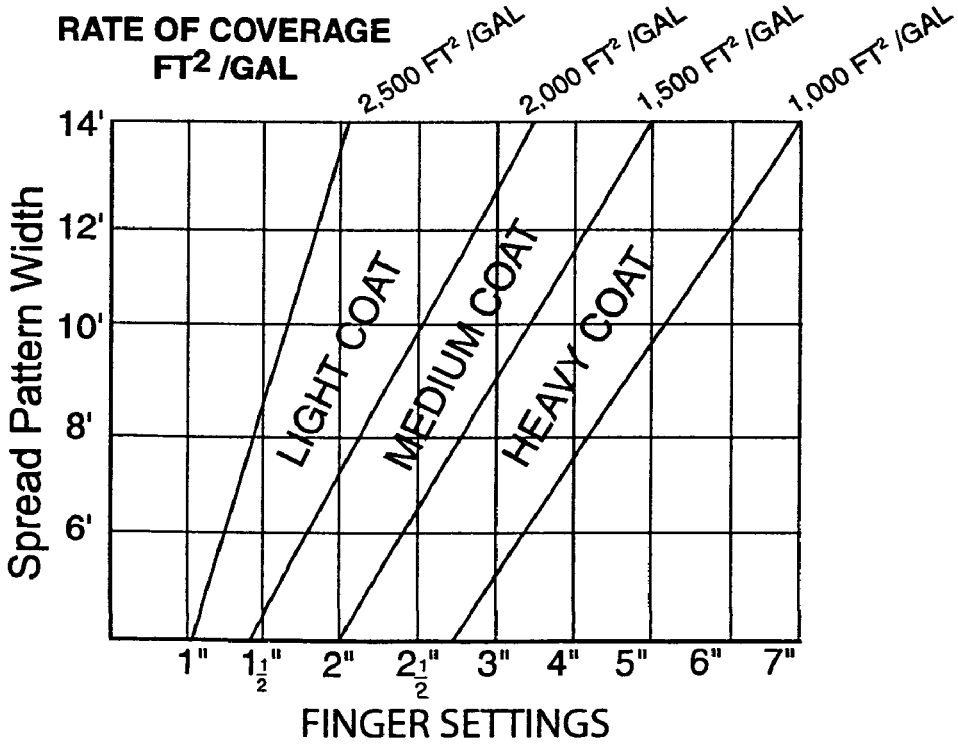
FIG. 5 is a graph of spread-pattern width v. finger-settings width.

When applying floor finish, in accordance with the principles of the invention, a worker goes through several steps. In a preliminary step, the worker checks the ambient temperature and humidity conditions, and looks at a chart such as the one shown in FIG. 4 to determine the proper thickness of the coating to be applied, as well as the thy-time for that coating. The worker also surveys the floor that is to be finished, and, at least mentally, divides the floor area into multiple sections. Each section should have a maximum length of 50 feet. In addition, the worker determines what is referred to as the "spread width" for each section, with the spread width typically being from about 6 feet to about 14 feet, depending upon factors such as the particular worker, the nature of the floor space, and the like. Having determined the coat thickness and spread width, the worker then uses a graph such as the one shown in FIG. 5 to determine how far apart the outwardly-extending tabs or fingers 34 should be positioned along the width indicator located on the horizontal portion of the lifting lever arm 30.

Figure 6:
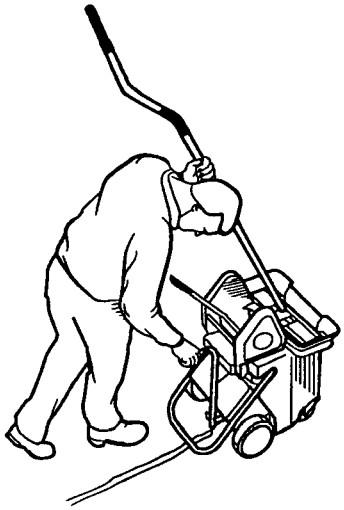
FIG. 6 is an elevated perspective view of a part of a method of the present invention.

FIG. 6 shows a worker having just started to lay a bead of a particular liquid or solution. The worker has turned the torquing portion of the handle from the left, closed position toward the right, thereby opening the spigot. The worker monitors the bead width by comparing the bead width with the width indicator; and the worker controls the bead width by turning the spigot handle slightly, either in the direction of the fully-closed- or fully-opened-position, and by adjusting their walking speed, and thus, the speed of the wheeled receptacle. Also, the worker is able to steer the receptacle with their right hand, using the wringer handle. In addition, depending upon the particular liquid being applied, the worker will be holding onto the handle of the floor tool, with the floor tool frame resting in the pad tray. In such instances, the worker also may exert a forward-propelling- and/or steering-force to the wheeled receptacle.

Figure 7A:
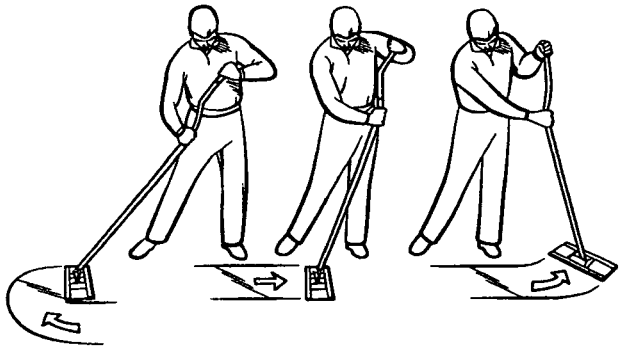
FIG. 7A is a frontal view of a portion of a method of the invention.
Figure 7B:
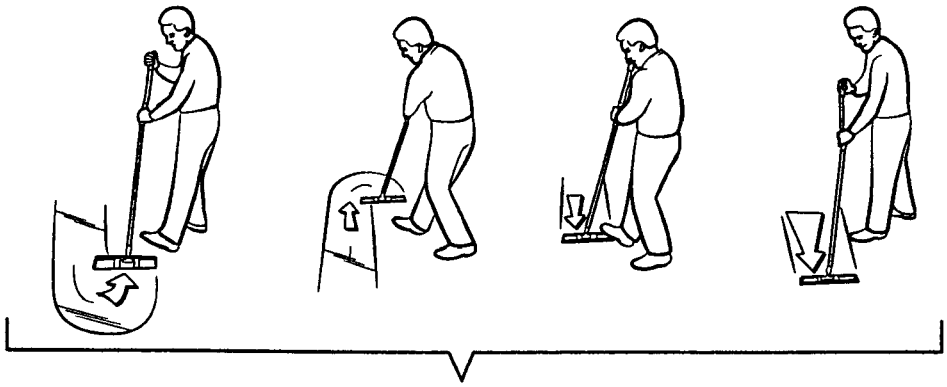
FIG. 7B is a side view of a portion of a method of the invention.

FIG. 7 depicts another inventive aspect of the method of applying a liquid to the surface of a floor. In further detail, FIG. 7A shows what is referred to as "the swing". In this movement, the worker shifts their weight side-to-side (much like a baseball- or golf-swing), using predominantly leg muscles, as opposed to arm- and/or back-muscles. FIG. 7B shows how the worker performs the very-specialized serpentine- or S-pattern of the invention, a movement which is quite different from a traditional mopping motion. In particular, with the floor-tool frame and pad to the worker's left, the worker steps back with the right foot and transfers body weight from the left foot to the right foot, while at the same time lifting the toes of the left foot, and sliding a good portion (e.g., a third to almost a half) of the pad and frame underneath the front of the left foot, thereby enabling the worker to keep their arms close to the body, which reduces worker fatigue dramatically. Once the worker has moved the pad across the front of their body, to the right side, the worker continues this "dance". This time however as the worker steps back with the left leg, the worker transfers their weight from the right leg to the left leg, lifts the front portion of their right foot off the floor, and slides the pad underneath the raised portion of the right foot.

Figure 8A:
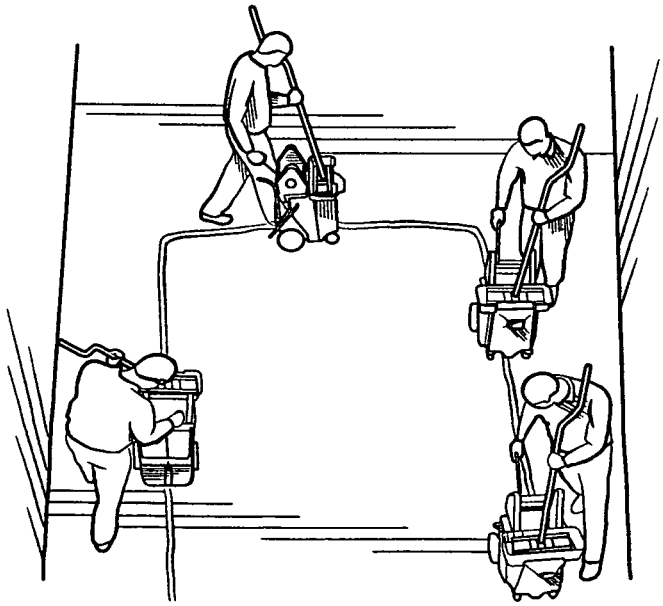
FIG. 8 is an elevated perspective view of several method steps of the invention.
Figure 8B:
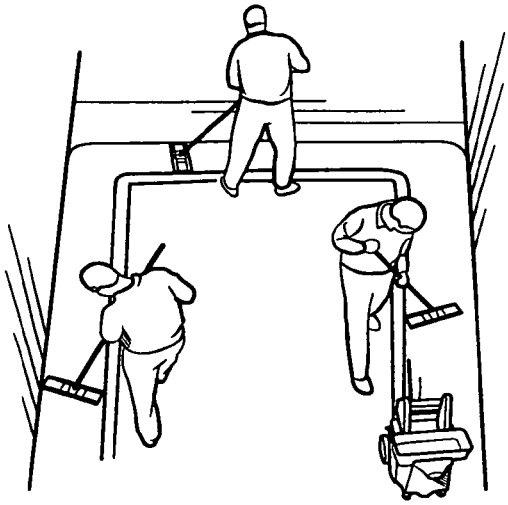
Figure 8C:
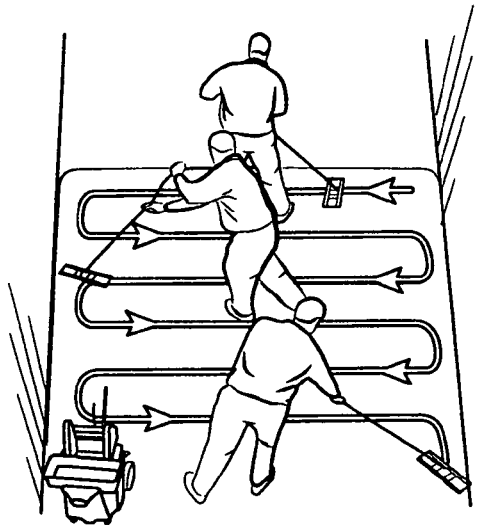

At this point, the worker may pre-moisten a microfiber pad (e.g., the B-111RM05 pad) in the pad tray before applying finish, if desired. The worker then dispenses a bead of finish on the floor in a U-shaped pattern, keeping the bead the same width as the finger setting (see FIG. 8A). Note that the worker stands to the left of the wheeled receptacle, with the worker's left side adjacent the edge of the particular section. Also, the worker steers with the right hand, and moves in a generally-counterclockwise direction, thereby providing a natural amount of spacing between the perimeter of the section and the location of the bead. The worker then should proceed immediately to the trimming- and spreading-steps shown in FIGS. 8B and 8C, respectively. If the worker allows the bead to dwell on the floor for an extended period of time, the bead may re-emulsify the previous coat of finish. As shown in FIG. 8B, the worker then trims the outer edges of the particular section, dipping into the bead as needed in order to keep the pad moist. Then, as shown in FIG. 8C, the worker spreads the bead of finish in a serpentine- or S-pattern, overlapping a one-half-pad-width with each pass until the particular section is filled in with finish. The worker performs the steps shown in FIGS. 8A-C with each section, until the floor has been covered. If an additional coat is to be applied to the floor, the worker allows proper dry time before applying the additional coating. For the best results, it is recommended that the worker not fan-dry the finish. Between coats, the pad should be rinsed, and may be hand-wrung to dry. Also, if desired, prior to applying another coat, the worker may test the floor with a piece of paper. If the coating has cured, then the paper will slide easily over the coating. Once the worker is done applying finish, the worker may drain any remaining finish solution from the receptacle directly into the original finish container, via the spigot. Because of the design of the wheeled receptacle, the finish solution in the receptacle remains uncontaminated throughout the process. Accordingly, the user is able to return any unused finish to its original container, thereby saving finish and reducing cost.

Figure 9A:
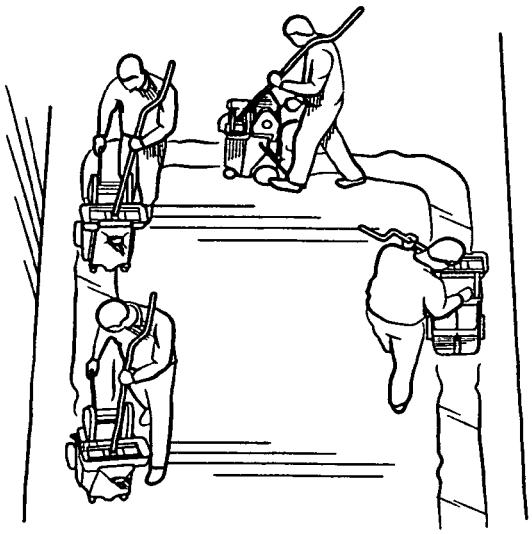
FIG. 9 is an elevated perspective view of another set of method steps of the invention.
Figure 9B:
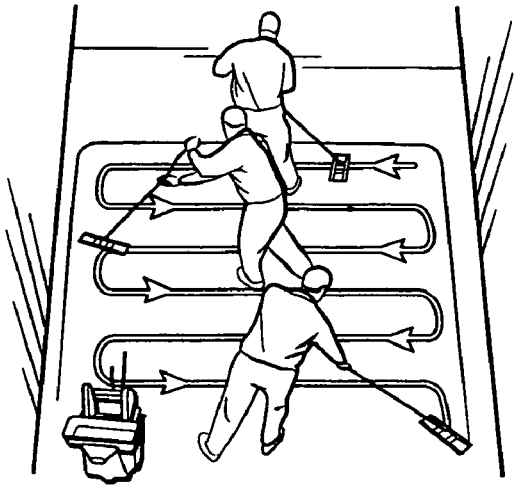
Figure 9C:
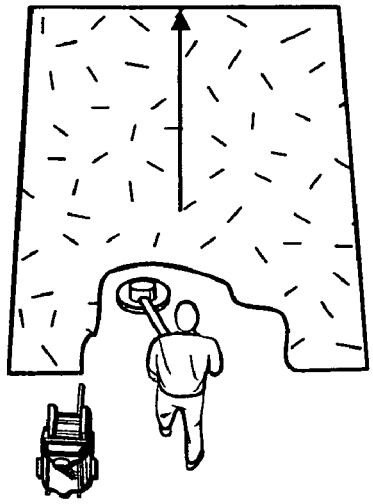

FIG. 9 is directed to floor-stripping and floor-degreasing applications. For such applications, the outwardly-extending tabs or fingers of the width indicator typically are spaced at least about 7 inches apart. In dividing the floor area into work sections, each section should have a maximum length of 25 feet, unless power equipment (auto scrubber, propane, etc.) also is used. As shown in FIG. 9A, the worker stands to the left of the receptacle, and steers the receptacle with the right hand. However, for these applications, the worker moves in a generally counter-clockwise direction; accordingly, the worker walks inwardly of the U-shaped pattern. FIG. 9B shows the worker using the serpentine- or S-maneuver to spread the stripper or degreaser edge to edge. If desired, the worker may use a pad such as the T-451 RM01 pad from the Charles Young Co. FIG. 9C shows a worker using a floor machine or brush to remove wax or buildup.

Figure 10A:
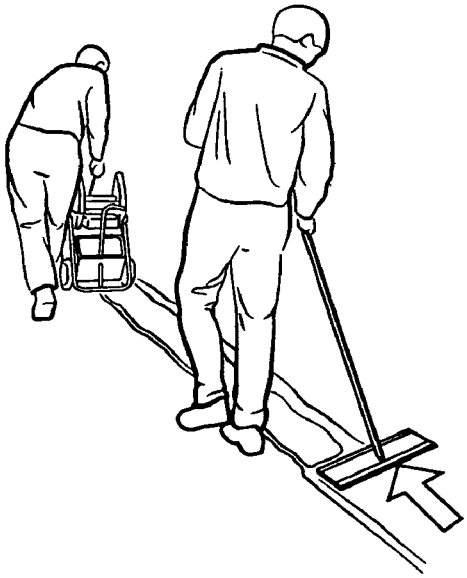
FIG. 10 is a perspective view of yet another set of method steps according to the present invention.
Figure 10B:
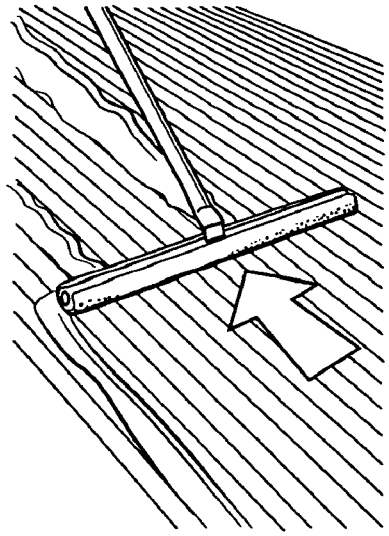

FIG. 10 shows workers applying floor finish to a wooden floor. In this situation, the tabs or fingers should be spaced approximately two to three inches apart. The workers may use an oil- or water-based gym finish, and the worker who is laying the bead (FIG. 10A) should run the bead in the direction of the boards. As shown in FIGS. 10A and 10B, a second worker follows behind, spreading the wood-floor finish with a weighted T-bar.

Figure 11A:
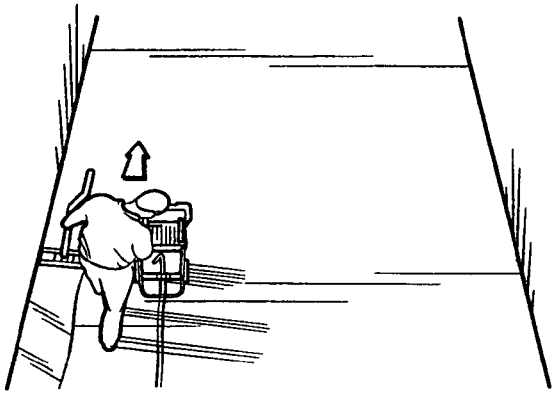
FIG. 11 is an elevated perspective view of a further set of method steps in accordance with the principles of the invention.
Figure 11B:
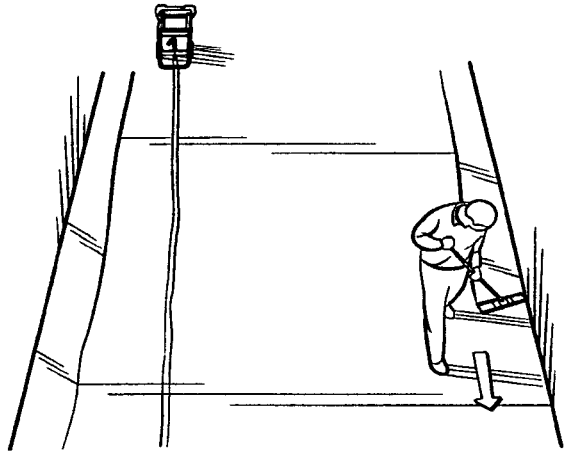
Figure 11C:
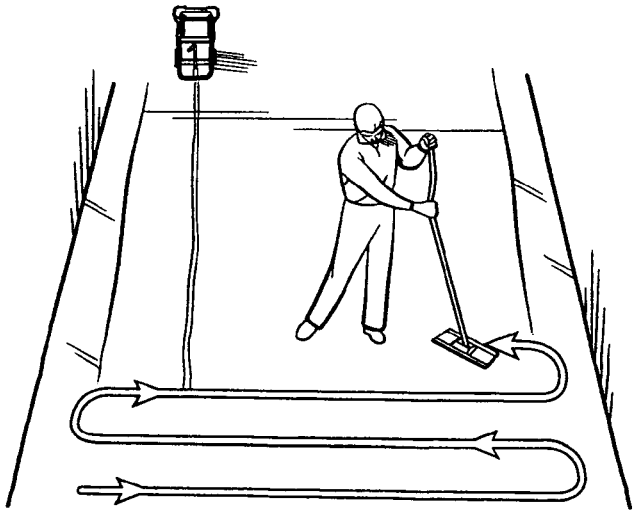

FIG. 11 shows a worker performing floor-cleaning. In this application, the tabs or fingers of the width indicator should be spaced approximately one to three inches apart. If desired, the worker may use a microfiber pad such as the T-451RM01 pad from Charles Young Co. The pad may be used either for dry mopping or for wet mopping. For wet-mopping purposes, an unused pad may be pre-moistened by dipping the pad into the liquid in the receptacle, or by creating a puddle on the floor by opening up the spigot for a few moments. FIG. 11 depicts a worker operating in a hallway or other similar type of corridor. As shown in FIG. 11A, the worker starts on the left side of the work space, with a moist cleaning pad on the floor adjacent the wall. The worker then moves forward, simultaneously dispensing cleaning solution and trimming the left hand side of the work space, applying the bead of cleaning solution in a substantially straight line. As shown in FIG. 11B, once the worker has reached the end of the length of the work space, the worker leaves the wheeled receptacle and, using the hand tool, trims the opposite side of the work section, dipping the pad into the single bead, as needed, in order to keep the pad moist. Then, as shown in FIG. 11C, the worker performs the serpentine- or S-pattern movement, moving backward, and overlapping each prior pass by about two inches.

While the present invention has been illustrated by a description of various versions, and while the illustrative versions have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A method of applying a liquid to a surface from a wheeled receptacle disposed on the surface, the wheeled receptacle including a circumferential sidewall having an upper end, a bottom wall connected to the circumferential sidewall, at least two wheels, a steering handle including a floor-tool handle, a spigot, and a spigot handle connected to the spigot, the spigot handle including a portion near the circumferential sidewall upper end, the wheeled receptacle containing the liquid, the method comprising the steps of:

opening the spigot by rotating the spigot handle in a first direction, thereby dispensing a portion of the liquid through the spigot of the wheeled receptacle and onto the surface;

guiding the wheeled receptacle across the surface via the steering handle, thereby dispensing the portion of the liquid through the spigot of the wheeled receptacle onto a selected area of the surface; and closing the spigot by rotating the spigot handle in a second direction.

2. A wheeled receptacle for applying a liquid to a surface on which the wheeled receptacle is supported, the wheeled receptacle comprising:

a circumferential sidewall including an upper end;

a bottom wall connected to the circumferential sidewall;

at least two wheels;

a steering handle for guiding the wheeled receptacle on the surface, the steering handle including a floor-tool handle;

a spigot through which a liquid flows onto the surface; and a spigot handle connected to the spigot, the spigot handle including a portion near the circumferential sidewall upper end, whereby a user opens the spigot by rotating the spigot handle in a first direction, and closes the spigot by rotating the spigot handle in a second direction.

3. A wheeled receptacle for applying a liquid to a surface on which the wheeled receptacle is supported, the wheeled receptacle comprising:

a circumferential sidewall;

a bottom wall connected to the circumferential sidewall;

at least two wheels;

a steering handle for guiding the wheeled receptacle on the surface, the steering handle including a floor-tool handle;

a spigot through which a liquid flows onto the surface; and a lifting handle comprising a width indicator that includes width indicia, whereby a user is able to compare a width of a portion of the liquid on the surface, which has flowed through the spigot onto the surface, with the width indicator.

4. A wheeled receptacle for applying a liquid to a surface on which the wheeled receptacle is supported, the wheeled receptacle comprising:

a circumferential sidewall;

a bottom wall connected to the circumferential sidewall;

at least two wheels;

a steering handle for guiding the wheeled receptacle on the surface, the steering handle including a floor-tool handle;

a spigot through which a liquid flows onto the surface;

a storage compartment including an outer wall distinct from the circumferential sidewall; and a spigot handle connected to the spigot and extending above the storage compartment outer wall, whereby a user opens the spigot by rotating the spigot handle in a first direction, and closes the spigot by rotating the spigot handle in a second direction.

* * * * *